US008397547B2

(12) United States Patent
Liu

(10) Patent No.: US 8,397,547 B2
(45) Date of Patent: Mar. 19, 2013

(54) UNLOCKING DEVICE FOR CONCEALING KEYHOLE OF LOCK AND KEY THEREFOR

(76) Inventor: Shih-Te Liu, Kaohsiung (TW)

( * ) Notice: Subject to any disclaimer, the term of this patent is extended or adjusted under 35 U.S.C. 154(b) by 368 days.

(21) Appl. No.: 12/566,069

(22) Filed: Sep. 24, 2009

(65) Prior Publication Data

US 2010/0077811 A1 Apr. 1, 2010

(30) Foreign Application Priority Data

Oct. 1, 2008 (TW) ..... 97217617 U

(51) Int. Cl.
*E05B 19/02* (2006.01)

(52) U.S. Cl. ..... 70/395; 70/408; 70/423; 70/453; 70/454; 70/455

(58) Field of Classification Search ..... 70/408, 70/395, 453–455, 423–428, DIG. 38, DIG. 47
See application file for complete search history.

(56) References Cited

U.S. PATENT DOCUMENTS

| | | | | | |
|---|---|---|---|---|---|
| 249,124 | A * | 11/1881 | Voos | 70/428 |
| 312,545 | A * | 2/1885 | Zeilin | 40/330 |
| 2,198,484 | A * | 4/1940 | Merkl | 70/395 |
| 2,301,531 | A * | 11/1942 | Falk | 76/110 |
| 2,724,959 | A * | 11/1955 | Young et al. | 70/408 |
| 3,208,249 | A * | 9/1965 | Stackhouse | 70/395 |
| 3,349,589 | A * | 10/1967 | Fricke | 70/395 |
| 3,630,053 | A * | 12/1971 | Krakauer | 70/51 |
| 4,735,069 | A * | 4/1988 | Steinbach | 70/491 |
| 5,077,996 | A | 1/1992 | Lien | |
| 5,329,792 | A | 7/1994 | Lee | |
| 6,494,064 | B1 | 12/2002 | Pena | |
| 7,866,194 | B2 * | 1/2011 | Liu | 70/395 |
| 2003/0159481 | A1 * | 8/2003 | McGuire et al. | 70/408 |
| 2004/0093920 | A1 * | 5/2004 | Howard | 70/408 |
| 2005/0229662 | A1 * | 10/2005 | Banks | 70/278.3 |
| 2006/0266089 | A1 * | 11/2006 | Dimig | 70/252 |
| 2007/0056340 | A1 * | 3/2007 | Boyd | 70/408 |
| 2010/0077815 | A1 * | 4/2010 | Liu | 70/451 |
| 2010/0326149 | A1 * | 12/2010 | Chang et al. | 70/423 |

FOREIGN PATENT DOCUMENTS

| | | |
|---|---|---|
| TW | M287361 | 2/2006 |

* cited by examiner

*Primary Examiner* — Lloyd Gall
(74) *Attorney, Agent, or Firm* — Alan Kamrath; Kamrath IP Lawfirm, P.A.

(57) ABSTRACT

An unlocking device includes a casing mounted to a side of a lock. A movable body is movably received in the casing along a first axis and has an opening. The lock has a keyhole in an extent of the opening. A key receiving seat is movable along a second axis perpendicular to the first axis between a first position received in the movable body and a second position at least partially outside of the movable body. A linking rod is extended into the movable seat. A key can be placed into a key receiving hole of the key receiving seat in the second position and then moved into the movable body to engage with the linking rod when the key receiving seat moves to the first position. The key is movable into the keyhole by moving the linking rod along the first axis and is rotatable for a locking or unlocking operation.

15 Claims, 8 Drawing Sheets

UNLOCKING DEVICE FOR CONCEALING KEYHOLE OF LOCK AND KEY THEREFOR

BACKGROUND OF THE INVENTION

1. Field of the Invention

The present invention relates to an unlocking device and, more particularly, to an unlocking device that conceals a keyhole of a lock and a key that can be received and guided by the unlocking device into the keyhole for locking and unlocking operations.

2. Description of the Related Art

Conventional locks include one or more lock cores that can be rotated for locking or unlocking purposes. The keyholes of the lock cores are generally exposed for receiving keys. However, the locks are liable to be picked through the exposed keyholes. Furthermore, the keys could be copied by probing the shapes of the exposed keyholes.

Taiwan Utility Model No. M287361 entitled "SAFETY LOCK WITH CONCEALED KEYHOLE" discloses a lock including a body receiving a lock core. An escutcheon is mounted to an outer side of the body and has an opening aligned with a keyhole of the lock core. A magnetic board is mounted inside the escutcheon and includes a through-hole aligned with the opening and having a diameter slightly smaller than the opening. A decorative cover can be retained in the opening by magnetic attraction to conceal the keyhole. However, the decorative cover can be easily removed by a magnet having larger magnetic attraction than the magnetic board or by picking the decorative cover through a gap between the decorative cover and an inner periphery of the opening.

SUMMARY OF THE INVENTION

The primary objective of the present invention is to provide an unlocking device for concealing a keyhole of a lock, preventing the keyhole from being seen and preventing direct access to the keyhole.

Another objective of the present invention is to provide an unlocking device that can guide a key into the keyhole of the lock for locking or unlocking purposes.

A further objective of the present invention is to provide an unlocking device for concealing the keyhole of the lock for providing an enhanced burglarproof effect.

A further objective of the present invention is to provide a key for operating the unlocking device as mentioned above for locking or unlocking purposes and providing an enhanced burglarproof effect.

The present invention fulfills the above objectives by providing, in a preferred form, an unlocking device including a casing adapted to be mounted to a side of a lock having a keyhole. The casing includes a compartment having first and second openings spaced along a first axis. The keyhole is located in an extent of the first opening. A movable body is movably received in the compartment of the casing along the first axis between a storage position received in the casing and an extended position at least partially outside of the casing. The movable body includes first and second sides spaced along the first axis. The movable body further includes third and fourth sides extending between the first and second sides and spaced along a second axis perpendicular to the first axis. The movably body further includes an insertion space intermediate the first and second sides along the first axis. The insertion space is delimited by first and second lateral walls spaced along the first axis. The second lateral wall is intermediate the first lateral wall and the first side of the movable body along the first axis. A third opening extends from the first lateral wall through the second side of the movable body and aligns with the keyhole. A through-hole extends from the first side of the movable body through the second lateral wall and aligned with the third opening. The insertion space has a fourth opening formed in the third side. A key receiving seat is movable along the second axis between a first position received in the insertion space of the movable body and a second position at least partially outside of the movable body. The key receiving seat includes a key receiving hole. A key is slideably received in the key receiving hole along the first axis. The key receiving hole of the key receiving seat is aligned with the third opening when the key receiving seat is in the first position. A linking rod extends through the through-hole of the movable body and includes first and second ends spaced along the first axis. The first end of the linking rod is manually rotatable. The second end of the linking rod has an engaging portion. The engaging portion is engaged with the key when the key receiving seat is in the first position. The key is disengaged from the engaging portion and removable from the key receiving seat when the key receiving seat is in the second position. The key is jointly movable with the linking rod along the first axis to releasably engage with the keyhole when the engaging portion of the linking rod is engaged with the key. Furthermore, the key is jointly rotatable with the linking rod about the first axis for unlocking or unlocking operation when the engaging portion of the linking rod is engaged with the key.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
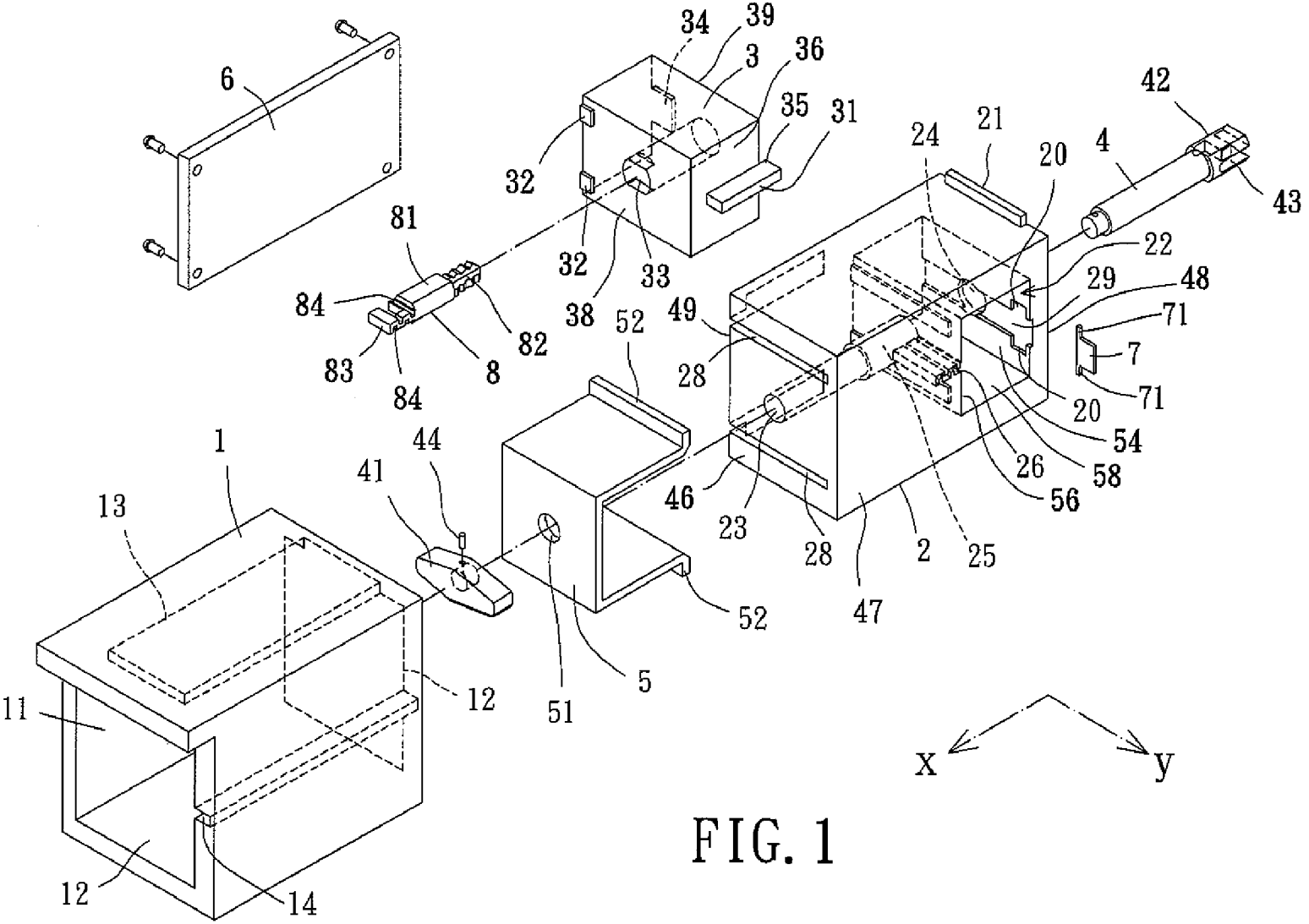
FIG. 1 shows an exploded, perspective view of an unlocking device according to the preferred teachings of the present invention.
Figure 2:
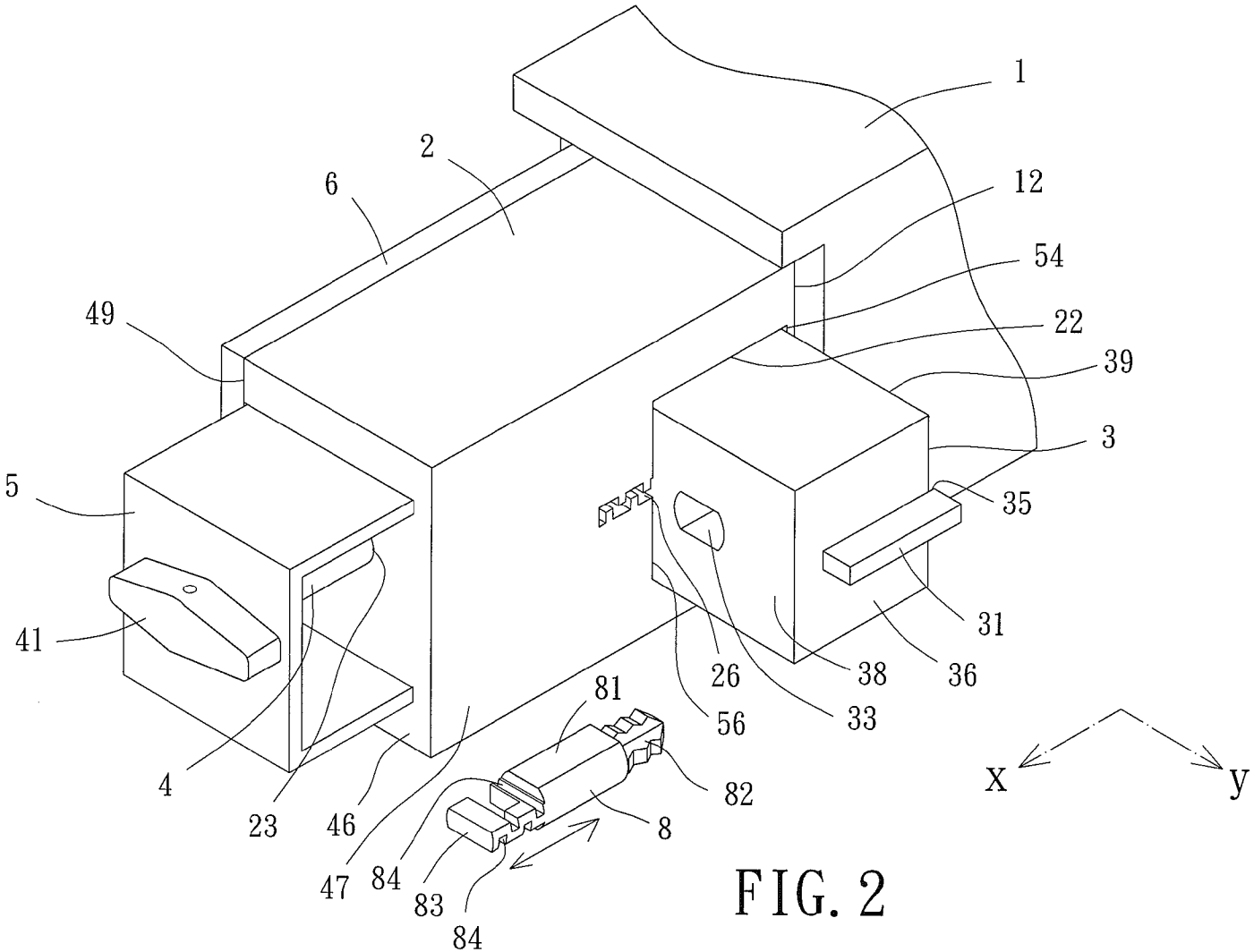
FIG. 2 shows a partial, perspective view of the unlocking device of FIG. 1.
Figure 3:
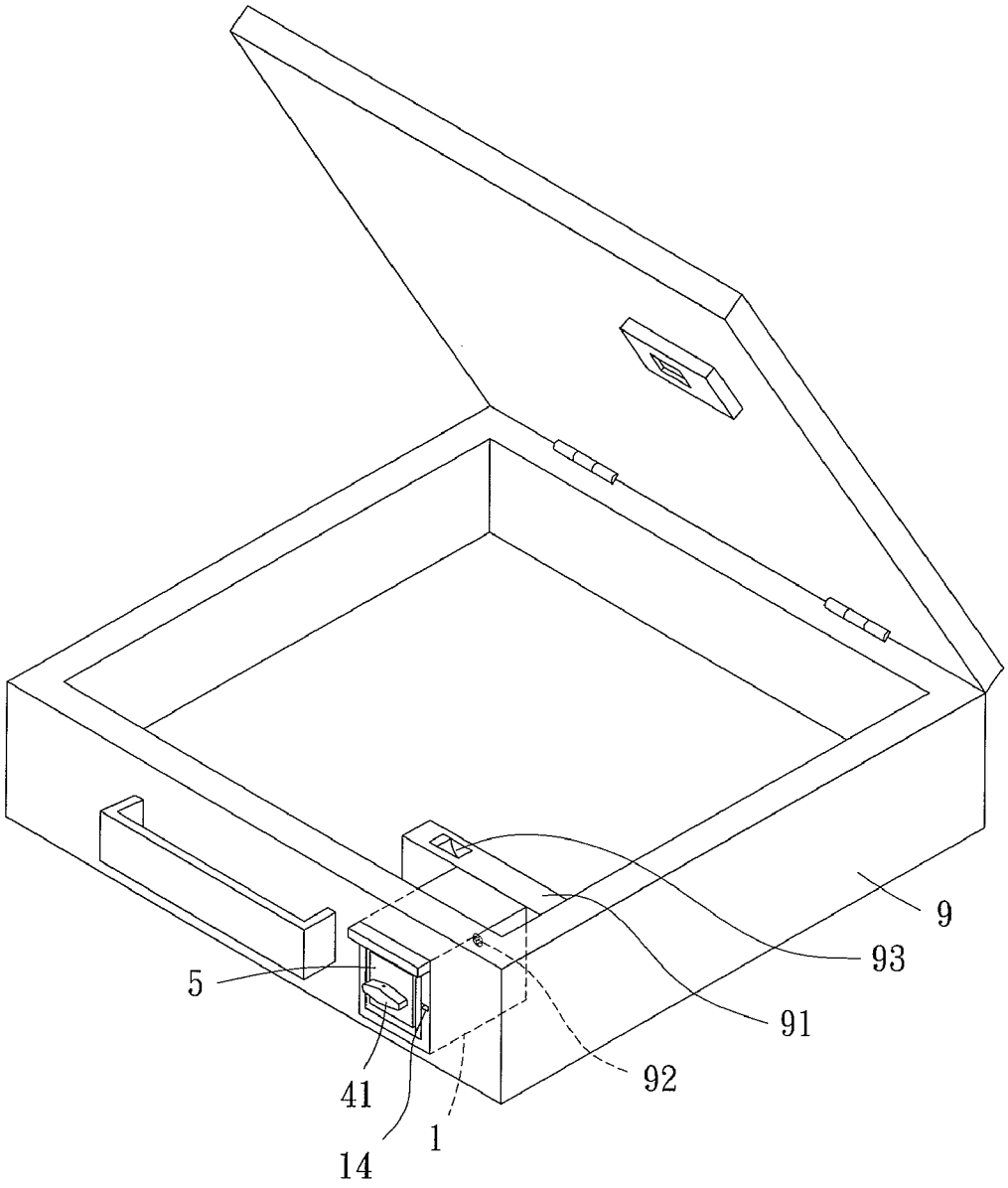
FIG. 3 shows a perspective view of a lock mounted to a box and equipped with the unlocking device of FIG. 1.
Figure 4:
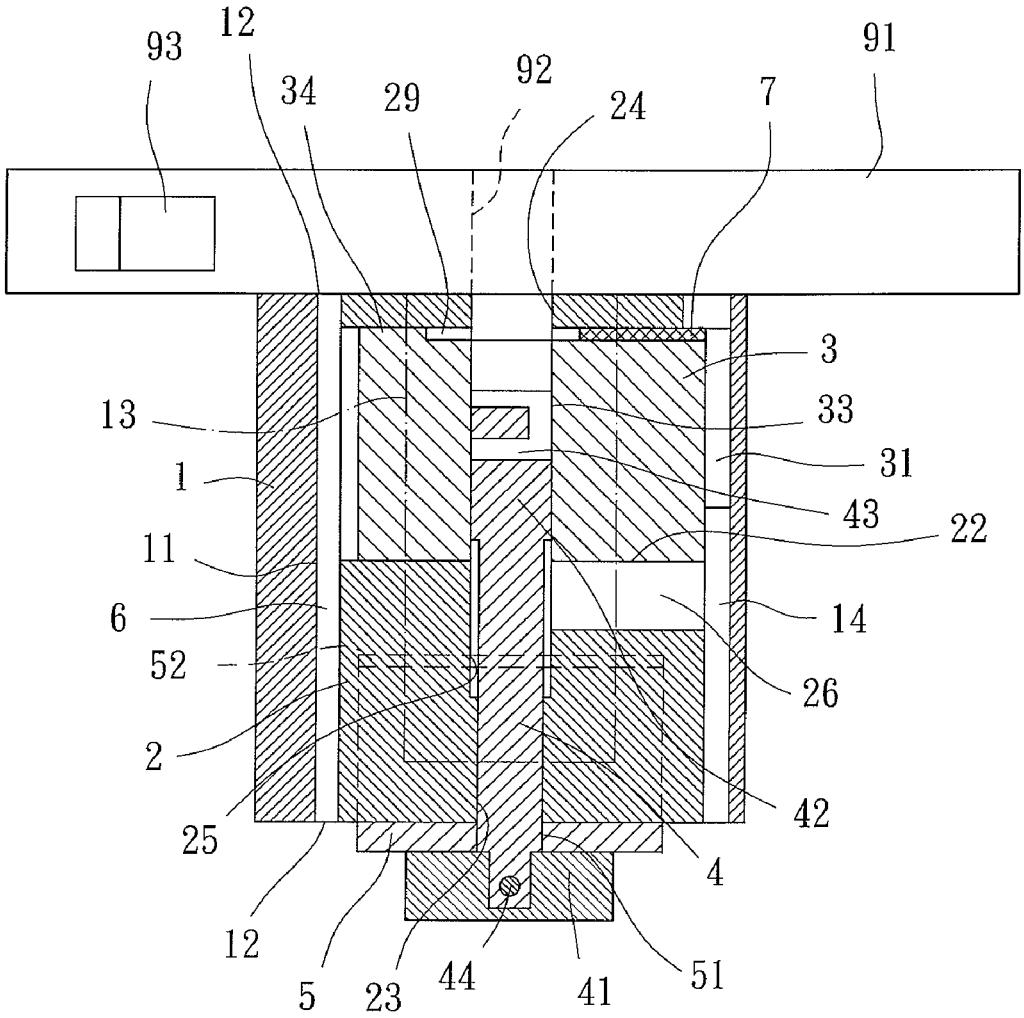
FIG. 4 shows a cross sectional view of the unlocking device of FIG. 1 with a movable body of the unlocking device in a storage position.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "inner", "end", "portion", "section", "outward", "inward", "upper", "lower", "spacing", "width", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An unlocking device according to the preferred teachings of the present invention is shown in the drawings. According to the preferred form shown, the unlocking device includes a casing 1, a movable body 2, a key receiving seat 3, and a linking rod 4.

According to the preferred form shown, the casing 1 is adapted to be mounted to a side of a lock 91 having a keyhole 92. The lock 91 is mounted in a box 9. The casing 1 includes a compartment 11 having first and second openings 12 spaced along a first axis X. The keyhole 92 is located in an extent of the first opening 12. In the most preferred form shown, a sidewall defining the compartment 11 includes a sliding groove 13 extending through the first opening 12 along the first axis X but spaced from the second opening 12. Another sidewall defining the compartment 11 includes a track 14.

According to the preferred form shown, the movable body 2 is movably received in the compartment 11 of the casing 1 along the first axis X between a storage position received in the casing 1 and an extended position at least partially outside of the casing 1. Specifically, the movable body 2 includes first and second sides 46 and 48 spaced along the first axis X. The movable body 2 further includes third and fourth sides 47 and 49 extending between the first and second sides 46 and 48 and spaced along a second axis Y perpendicular to the first axis X. The movably body 2 further includes an insertion space 22 intermediate the first and second sides 46 and 48 along the first axis X. The insertion space 22 is delimited by first and second lateral walls 54 and 56 spaced along the first axis X. The second lateral wall 56 is intermediate the first lateral wall 54 and the first side 46 of the movable body 2 along the first axis X. A third opening 24 extends from the first lateral wall 54 through the second side 48 of the movable body 2. The third opening 24 is aligned with the keyhole 92. A through-hole 23 extends from the first side 46 of the movable body 2 through the second lateral wall 56 and aligns with the third opening 24. The insertion space 22 has a fourth opening 58 formed in the third side 47 of the movable body 2.

In the most preferred form shown, the movable body 2 further includes a side groove 26 extending from the third side 47 through an inner periphery of the through-hole 23. The side groove 26 further extends from the second lateral wall 56 towards but spaced from the first side 46 of the movable body 2. The through-hole 23 of the movable body 2 has an enlarged receiving section 25 in communication with the insertion space 22 and the side groove 26 and having a diameter larger than the through-hole 23. The side groove 26 extends from the third side 47 through the inner periphery of the receiving section 25. Furthermore, the first lateral wall 54 includes a guiding groove 29 with a wider section 20. A stop 7 is slideably received in the wider section 20 along the second axis Y and includes two lugs 71 on upper and lower sides thereof. Further, the movable body 2 includes a restraining portion 21 formed on a top side thereof. Movement of the movable body 2 along the first axis X is stopped when the restraining portion 21 comes in contact with an end wall of the sliding groove 13 of the casing 1. The restraining portion 21 is slideably received in the sliding groove 13 of the casing 1. The restraining portion 21 can be in the form of a protrusion or strip slideably received in the sliding groove 13. It can be appreciated that the sliding groove 13 does not have to be in communication with the compartment 11. Furthermore, the sliding groove 13 can be formed in the movable body 2, and the restraining portion 21 can be formed on the casing 1 to provide the same restraining effect for limiting relative movement between the movable body 2 and the casing 1 along the first axis X. The movable body 2 further includes two guiding grooves 28 extending from the first side 46 towards but spaced from the second lateral wall 56 and having a width along the second axis Y larger than the opening 12.

According to the preferred form shown, the key receiving seat 3 is movable along the second axis Y between a first position received in the insertion space 22 of the movable body 2 and a second position at least partially outside of the movable body 2. The key receiving seat 3 includes a key receiving hole 33 extending from a first side 38 through a second side 39 of the key receiving seat 3 and having first and second ends spaced along the first axis X. The first end of the key receiving hole 33 formed in the first side 38 has non-circular cross sections. Two blocks 32 are formed on the first side 38. A push block 34 is formed on the second side 39. The key receiving seat 3 further includes a handle 31 formed on a third side 36 extending between the first and second sides 38 and 39. The handle 31 has an end 35 extending beyond the key receiving seat 3 along the first axis X. The stop 7 does not block the second end of the key receiving hole 33 when the key receiving seat 3 is in the first position. The push block 34 pushes the stop 7 to shield the second end of the key receiving hole 33 when the key receiving seat 3 moves from the first position to the second position. The end 35 of the handle 31 pushes the stop 7 back to its initial position not shielding the second end of the key receiving hole 33 when the key receiving seat 3 moves from the second position to the first position. It can be appreciated that the lugs 71 of the stop 7 slide in and are guided by the wider section 20 of the guiding groove 29 while the stop 7 is pushed by the push block 34 or the end 35 of the handle 31.

According to the preferred form shown, the linking rod 4 extends through the through-hole 23 of the movable body 2. The linking rod 4 includes first and second ends spaced along the first axis X. A knob 41 is fixed by a fastener 44 such as a pin or screw to the first end of the linking rod 4. The second end of the linking rod 4 has an engaging portion 42 having an engaging groove 43. The engaging portion 42 of the linking rod 4 is disengageably received in the receiving section 25 of the movable body 2 and has a maximum diameter larger than a diameter of the linking rod 4 and smaller than a diameter of the third opening 24 of the movable body 2. In the most preferred form shown, the engaging portion 42 of the linking rod 4 has non-circular cross sections corresponding to the first end of the key receiving hole 33.

According to the preferred form shown, the unlocking device further includes a support 5 having a main section with a hole 51 aligned with the through-hole 23 of the movable body 2. The knob 41 is fixed to the end of the linking rod 4 extending beyond the hole 51 of the support 5. The support 5 further includes two arms on opposite sides of the main section and slideably received in the guiding grooves 28 of the movable body 2. Each arm has a restraining member 52 for restraining movement of the support 5 relative to the movable body 2 along the first axis X without the risk of disengagement of the support 5. It can be appreciated that the support 5 can include only one arm, and the movable body 2 can include only one guiding groove 28.

According to the most preferred form shown, a cover 6 is fixed to the fourth side 49 of the movable body 2 to shield a side of each of the insertion space 22 and the guiding grooves 28. The cover 6 can be fixed by screwing, male/female coupling, bonding, or other suitable provisions to the movable body 2. However, the movable body 2, the key receiving seat 3, and the support 5 can be coupled together by other suitable provisions instead of using the cover 6.

According to the preferred form shown, a key 8 includes an end having a toothed portion 82 insertable into the keyhole 92 of the lock 91. The toothed portion 82 is configured to actuate tumbler pins in the lock 91 for driving a latch 93 of the lock 91 upon rotating the key 8. A coupling portion 83 is formed on the other end of the key 8. The key 8 further includes an insertion portion 81 intermediate the toothed portion 82 and the coupling portion 83 and having cross sections corresponding to the non-circular cross sections of the side groove 26 of the movable body 2. Specifically, the coupling portion 83 has a first side with at least one recessed portion 84 having a depth not smaller than half of a thickness of the coupling portion 83. The coupling portion 83 further includes a second side opposite to the first side. The second side of the coupling portion 83 includes at least one recessed portion 84 not aligned with recessed portions 84 of the first side. In the most preferred form shown, each of the first and second sides of the coupling portion 83 includes a plurality of recessed portions 84 with different spacings therebetween. It can be appreciated that each of the first and second sides of the coupling portion 83 can include only one or more recessed portions 84 other than those shown in the figures. Furthermore, the side groove 26 has corresponding protrusions allowing the coupling portion 83 of the key 8 to be inserted through the side groove 26 into the receiving section 25 of the through-hole 23 along the second axis Y. However, the protrusions can be formed on the coupling portion 83, and the recessed portions 84 can be formed in the side groove 26. Thus, only the key 8 with a correct coupling portion 83 can be inserted into the side groove 26, providing enhanced burglarproof effect.

In use, the unlocking device according to the preferred teachings of the present invention is mounted to the side of the lock 91 mounted in the box 9 with the third opening 24 of the movable body 2 aligned with the keyhole 92 and with the knob 41 outside of the box 9. The keyhole 92 of the lock 91 is concealed in the box 9 and can not be seen from outside. The latch 93 of the lock 91 can be operated by operating the knob 41, which will be described later. The unlocking device according to the preferred teachings of the present invention can be mounted to the side of the lock 91 by any suitable provisions. As an example, the casing 1 can include a fixing portion that can be screwed to the side of the lock 91. In another example, an additional fixing seat can be provided to fix the unlocking device in place. It can be appreciated that the unlocking device according to the preferred teachings of the present invention can be utilized with locks other than the lock 91 shown, such as locks for boxes, door locks, U-shaped locks, and vehicle locks.

Figure 5:
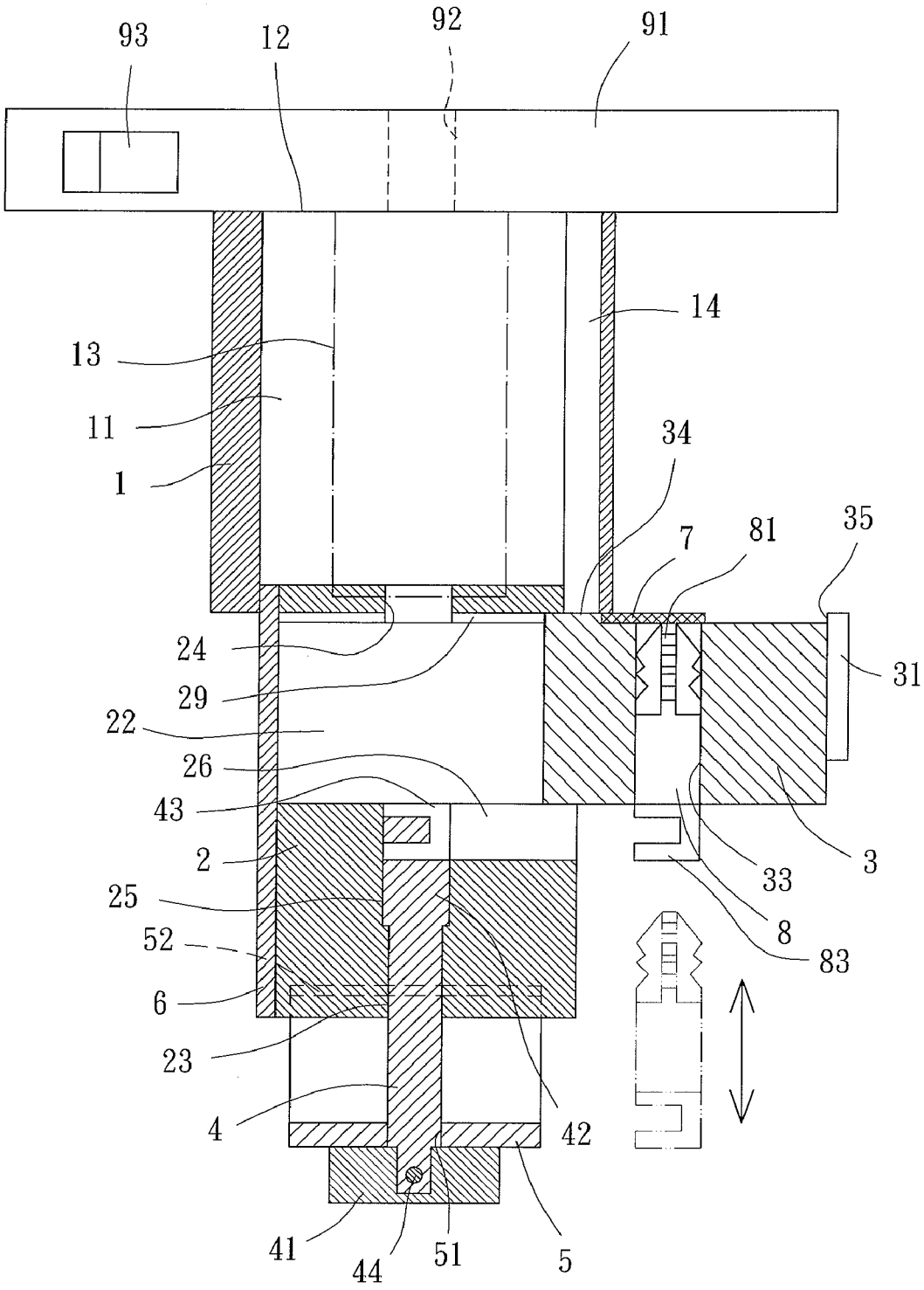
FIG. 5 shows another cross sectional view of the unlocking device of FIG. 1 with the movable body in an extended position and with a key receiving seat of the unlocking device in a position outside of the movable body for receiving a key.

In operation, the linking rod 4 is moved along the first axis X by pulling at the knob 41 away from the casing 1. The support 5 is also moved outward until the engaging portion 42 of the linking rod 4 is received in the receiving section 25 of the movable body 2. The movable body 2 is also carried outward by the linking rod 4 to the extended position. The handle 31 of the key receiving seat 3 is exposed when the movable body 2 is in the extended position. It can be appreciated that the handle 31 is slideably received in the track 14 when the movable body 2 moves along the first axis X while the key receiving seat 3 is received in the insertion space 22. Then, the key receiving seat 3 is moved from the first position to the second position via the fourth opening 58 of the movable body 2 by pulling at the handle 31, revealing the key receiving hole 33 (FIG. 5). The key 8 is inserted into the key receiving hole 33 in a certain orientation with the coupling portion 83 outside of the key receiving seat 3 and aligned with the side groove 26 of the movable body 2. As mentioned above, the stop 7 shields the second end of the key receiving hole 33 when the key receiving seat 3 is in the second position, preventing falling of the key 8 out of the key receiving hole 33 and positioning the key 8 in the desired location.

Figure 6:
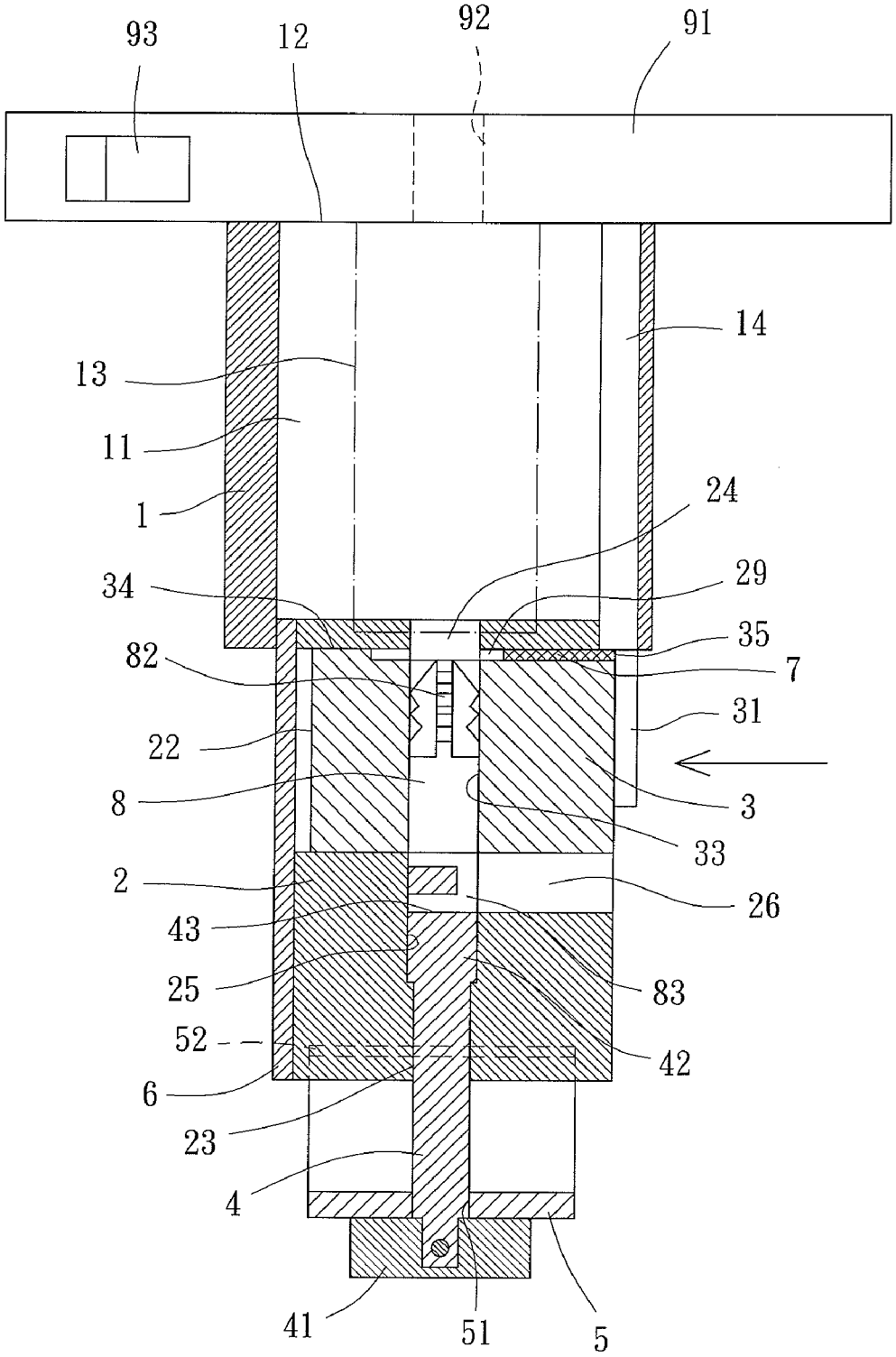
FIG. 6 shows another cross sectional view of the unlocking device of FIG. 1 with the movable body in an extended position, with the key receiving seat received in the movable body, and with a key received in the key receiving seat.
Figure 7:
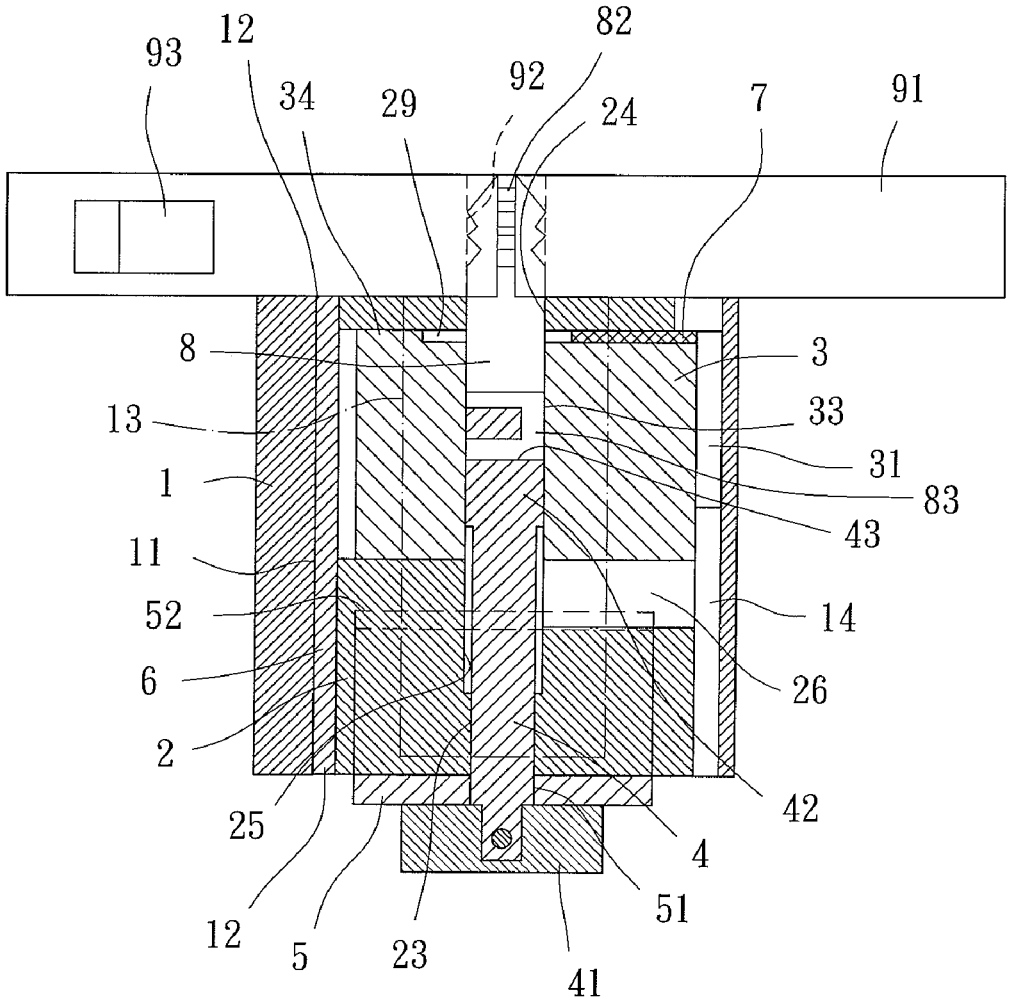
FIG. 7 shows another cross sectional view of the unlocking device of FIG. 1 with the movable body in the storage position and with a key received in the key receiving seat.

Next, the key receiving seat 3 is pushed back to the first position in the insertion space 22 of the movable body 2. The coupling portion 83 of the key 8 is received in the receiving section 25 of the movable body 2 and engages with the engaging groove 43 of the linking rod 4, and the toothed portion 82 of the key 8 is received in the insertion space 22 of the movable body 2 (FIG. 6). The stop 7 does not block the second end of the key receiving hole 33 when the key receiving seat 3 is in the first position, as mentioned above. Then, the linking rod 4 is pushed to move toward the casing 1 along the axis X, moving the support 5 into the movable body 2 and moving the movable body 2 into the compartment 11 of the casing 1. The toothed portion 82 of the key 8 is pushed by the linking rod 4 through the third opening 24 of the movable body 2 into the keyhole 92 of the lock 91 (FIG. 7). Next, the knob 41 of the linking rod 4 is rotated in a direction about the first axis X to drive the latch 93 for an unlocking operation.

Figure 8:
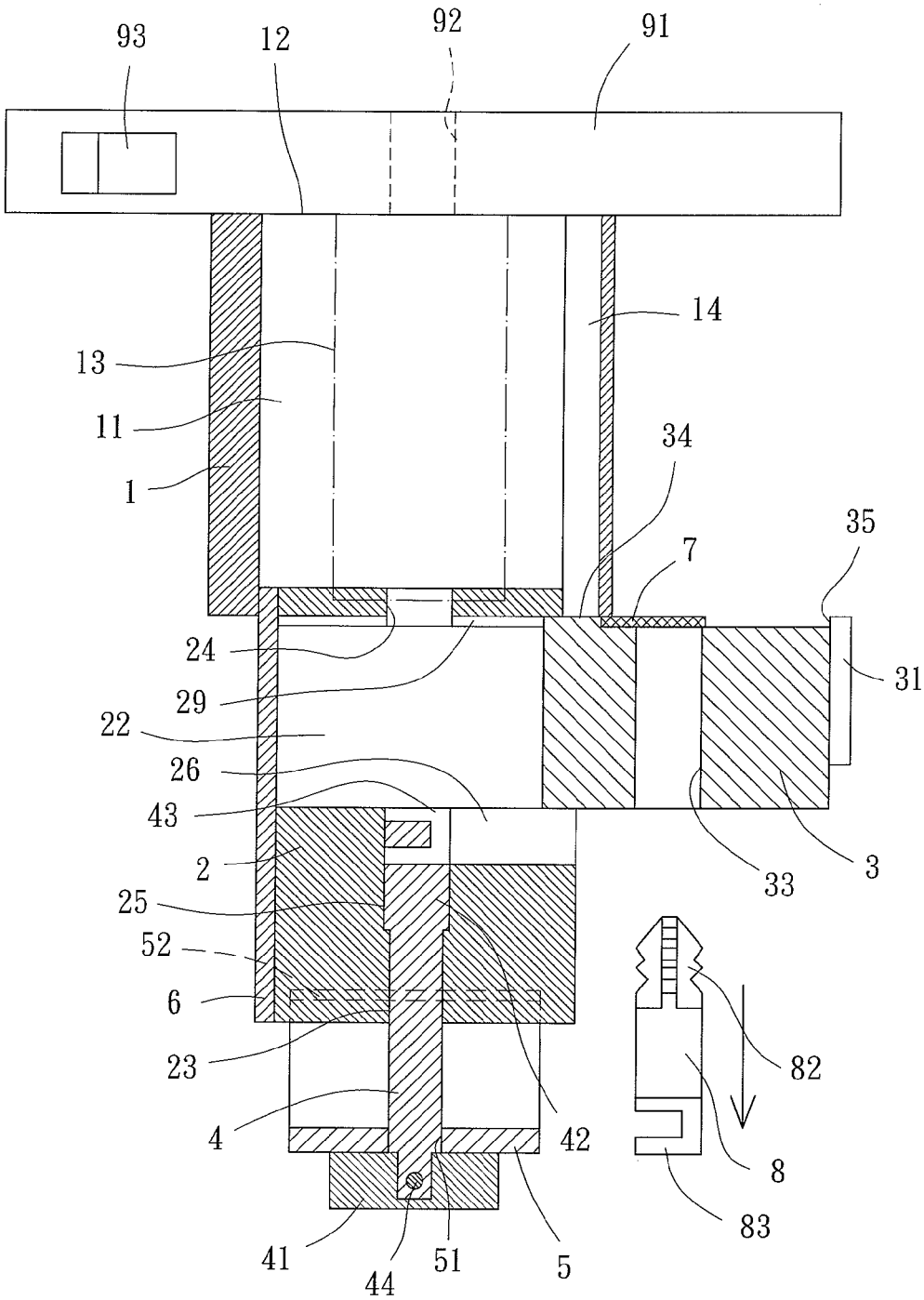
FIG. 8 shows another cross sectional view of the unlocking device of FIG. 1 with the movable body in an extended position and with the key receiving seat of the unlocking device in a position outside of the movable body for removing the key.

The key 8 can be removed after moving the movable body 2 to the extended position and moving the key receiving seat 3 to the second position (FIG. 8). When locking of the lock 91 is required, the above procedure can be repeated to insert the key 8 into the keyhole 92. The knob 41 can be rotated in a reverse direction to move the latch 93 to a locking position.

According to the above, the unlocking device according to the preferred teachings of the present invention can guide the key 8 into the keyhole 92 of the lock 91 as well as conceal the keyhole 92 to prevent direct access to the keyhole 92.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An unlocking device comprising:

a movable body including first and second sides spaced along a first axis, with the movable body further including third and fourth sides extending between the first and second sides and spaced along a second axis perpendicular to the first axis, with the movable body further including an insertion space intermediate the first and second sides along the first axis, with the insertion space delimited by first and second lateral walls spaced along the first axis, with the second lateral wall intermediate the first lateral wall and the first side of the movable body along the first axis, with an opening extending from the first lateral wall through the second side of the movable body, with a through-hole extending from the first side of the movable body through the second lateral wall and aligned with the opening extending from the first lateral wall through the second side;

a key receiving seat movable along the second axis between a first position received in the insertion space of the movable body and a second position at least partially outside of the movable body, with the key receiving seat including a key receiving hole, with a key slideably received in the key receiving hole along the first axis, with the key receiving hole of the key receiving seat aligned with the opening extending from the first lateral wall through the second side when the key receiving seat is in the first position; and a linking rod extending through the through-hole of the movable body, with the linking rod including first and second ends spaced along the first axis, with the first end of the linking rod being manually rotatable, with the second end of the linking rod having an engaging portion, with the engaging portion engaged with the key when the key receiving seat is in the first position, with the key disengaged from the engaging portion and removable from the key receiving seat when the key receiving seat is in the second position, with the key being jointly rotatable with the linking rod about the first axis for a locking or unlocking operation when the engaging portion of the linking rod is engaged with the key.

2. The unlocking device as claimed in claim 1, with the movable body further including a side groove extending from the third side through an inner periphery of the through-hole, with the side groove further extending from the second lateral wall towards but spaced from the first side of the movable body.

3. The unlocking device as claimed in claim 2, with the through-hole of the movable body having an enlarged receiving section in communication with the insertion space and the side groove and having a diameter larger than the through-hole.

4. The unlocking device as claimed in claim 1, with the key receiving hole of the key receiving seat having a maximum diameter larger than a maximum diameter of the engaging portion of the linking rod.

5. The unlocking device as claimed in claim 1, with the key receiving hole of the key receiving seat including an end having non-circular cross sections, and with the key including an insertion portion having cross sections corresponding to the non-circular cross sections of the end of the key receiving hole.

6. The unlocking device as claimed in claim 1, further comprising: a support slideably movable relative to the movable body along the first axis, with the support including a hole through which the linking rod extends, with one of the support and the movable body including a guiding groove, with the other of the support and the movable body including a restraining member for restraining movement of the support relative to the movable body along the first axis, with a knob fixed to the first end of the linking rod extending through the hole of the support.

7. The unlocking device as claimed in claim 1, further comprising:

a casing adapted to be mounted to a side of a lock having a keyhole, with the casing including a compartment having first and second openings spaced along the first axis, with the keyhole located in an extent of the first opening, with the movable body movably received in the compartment of the casing along the first axis between a storage position received in the casing and an extended position at least partially outside of the casing, with the opening extending from the first lateral wall through the second side aligned with the keyhole, and with the key being jointly movable with the linking rod along the first axis to releasably engage with the keyhole.

8. The unlocking device as claimed in claim 7, with the first lateral wall including a guiding groove with a wider section, with a stop slideably received in the wider section along the second axis, with the stop not blocking an end of the key receiving hole when the key receiving seat is in the first position, with the key receiving seat including a push block, with the push block pushing the stop to shield the end of the key receiving hole when the key receiving seat moves from the first position to the second position.

9. The unlocking device as claimed in claim 8, with the insertion space having an opening formed in the third side, with the key receiving seat including a side exposed via the opening formed in the third side of the movable body, with a handle formed on the side of the key receiving seat, with the handle having an end extending beyond the key receiving seat along the first axis, with the end of the handle pushing the stop back to its initial position not shielding the end of the key receiving hole when the key receiving seat moves from the second position to the first position.

10. The unlocking device as claimed in claim 9, with the key including an end with a toothed portion adapted to be inserted into the keyhole for the locking or unlocking operation, with the key further including another end having a coupling portion releasably engaged in the engaging portion of the linking rod.

11. The unlocking device as claimed in claim 10, with the coupling portion of the key moving through a side groove of the movable body into the through-hole of the movable body when the key receiving seat moves from the second position to the first position, with one of the coupling portion of the key and the side groove having a plurality of recessed portions, with the other of the coupling portion of the key and the side groove having a plurality of protruded portions slideably received in the plurality of recessed portions along the second axis.

12. The unlocking device as claimed in claim 1, with the key comprising a body having a first end, a second end, and an axis extending through the first and second ends, with a toothed portion adjacent the first end of the body, with a coupling portion adjacent to the second end of the body, with an insertion portion having non-circular cross sections perpendicular to the axis of the body and located intermediate the toothed portion and the coupling portion, with the non-circular cross sections including at least one linear side and at least one arcuate side, with the body between the first end of the body and the insertion portion and between the second end of the body and the insertion portion having a radial extent from the axis of the body less than the non-circular cross sections of the insertion portion.

13. The unlocking device as claimed in claim 12, with the coupling portion having a first side with at least one recessed portion extending tangentially to the axis of the body and entirely across the coupling portion.

14. The unlocking device as claimed in claim 13, with the at least one recessed portion having a depth perpendicular to the axis of the body not smaller than a half of a thickness of the coupling portion perpendicular to the axis of the body.

15. The unlocking device as claimed in claim 13, with the first side of the coupling portion including a plurality of recessed portions with different spacings parallel to the axis of the body therebetween.

* * * * *